United States Patent [19]

Nakamura et al.

[11] 4,309,476

[45] Jan. 5, 1982

[54] CORE-IN-SHEATH TYPE AROMATIC POLYAMIDE FIBER AND PROCESS FOR PRODUCING THE SAME

[75] Inventors: Tsutomu Nakamura, Yamaguchi; Yasuo Nakagawa, Iwakuni; Osamu Kai, Iwakuni; Keizo Shimada, Iwakuni, all of Japan

[73] Assignee: Teijin Limited, Osaka, Japan

[21] Appl. No.: 140,100

[22] Filed: Apr. 14, 1980

[30] Foreign Application Priority Data

Apr. 24, 1979 [JP] Japan ..... 54-49779

[51] Int. Cl.[3] ..... D02G 3/00

[52] U.S. Cl. ..... 428/373; 264/184; 428/397; 428/400

[58] Field of Search ..... 428/373, 374, 397, 400, 428/364; 264/171, 184

[56] References Cited

U.S. PATENT DOCUMENTS

| | | | |
|---|---|---|---|
| 2,989,798 | 6/1961 | Bannerman | 428/373 |
| 3,600,271 | 8/1971 | Ono et al. | 428/397 X |
| 3,695,992 | 10/1972 | Moulds | 428/398 |
| 3,944,708 | 3/1976 | Dumas | 428/398 X |
| 4,075,378 | 2/1978 | Anton et al. | 428/374 |

*Primary Examiner*—Lorraine T. Kendell

*Attorney, Agent, or Firm*—Burgess, Ryan and Wayne

[57] ABSTRACT

An aromatic polyamide fiber having an excellent dyeing property has a core-in-sheath type structure, in which the core portion is insoluble and the sheath portion is soluble in N-methyl-2-pyrrolidone at 35° C.

7 Claims, 5 Drawing Figures

CORE-IN-SHEATH TYPE AROMATIC POLYAMIDE FIBER AND PROCESS FOR PRODUCING THE SAME

FIELD OF THE INVENTION

The present invention relates to a core-in-sheath type aromatic polyamide fiber and a process for producing the same. More particularly, the present invention relates to a core-in-sheath type aromatic polyamide fiber having an excellent dyeing property and good thermal and mechanical properties, and a process for producing the same.

BACKGROUND OF THE INVENTION

It is known that the so-called wholly aromatic polyamide resins have higher softening and melting points then those of aliphatic polyamide resins, and exhibit desirable physical and chemical properties, such as: excellent heat-resisting properties, for example, a high ratio of mechanical strength at an elevated temperature to that at a room temperature, superior stabilities in dimension and shape at an elevated temperature, and a high resistance to thermal decomposition; high resistances to various chemicals; superior electrical properties, for example, a high dielectric breakdown strength, and superior mechanical properties, for example, a high tensile strength and high Young's modulus. Also, it is known that the wholly aromatic polyamide resins have high orienting and crystallizing properties. Accordingly, the wholly aromatic polyamide resins are suitable as a material for producing filaments, fibers and films having a high heat resistance, a superior flame-retarding property, and high tensile strength and Young's modulus.

However, the conventional filaments or fibers consisting of the wholly aromatic polyamide exhibit a disadvantage in that it is difficult to dye the filaments or fibers by conventional dyeing procedures, due to the high degrees of orientation and crystallinity thereof. Accordingly, the conventional wholly aromatic polyamide filaments or fibers are utilized, in the non-dyed form, as electricinsulating material for motors and transformers, or as industrial materials for producing filter bags or heating tubes, which materials are not required to be colored. However, the conventional wholly aromatic polyamide filaments or fibers are not used as materials which are required to be beautifully colored, for example, materials for clothing. Accordingly, it is desirable to provide a new type of aromatic polyamide material which is suitable for producing the filaments or fibers which can be easily dyed with conventional dyes.

Generally, an artificial polymer fiber having high degres of orientation and crystallinity of the polymer molecules exhibits a poor dyeing property. In other words, the dyeing property of the artificial polymer fiber can be improved by decreasing the degrees of orientation and crystallinity of the polymer molecules in the fiber. Therefore, in the case of the wholly aromatic polyamide fiber, various approaches for impvoring the dyeing property thereof, by introducing a functional radical having a high degree of affinity to dyes into the polymer molecules, or by blending the aromatic polyamide with a polymer having a high degree of affinity to dyes have been proposed.

Japanese Patent Application Publication No. 45-34776(1970) disclosed a method for producing filaments or fibers from a modified aromatic polyamide copolymer which contains repeating units having a functional radical which exhibits a high degree of affinity to dyes, for example, sulfonic acid radical, tertiary amino radical and quaternary ammonium radical. Also, each of Japanese Patent Application Publications Nos. 49-32658(1974), 49-32659(1974), 49-33594(1974) and 50-8106(1975) disclosed a method for producing filaments or fibers from a composition containing the above-mentioned modified aromatic polyamide copolymer and a non-modified wholly aromatic polyamide. However, it was found that the above-mentioned fibers or filaments exhibited a significantly poor heat resisting property, which is very important when they are used practically, while the filaments or fibers exhibited an enhanced dyeing property.

For example, Japanese Patent Application Publication No. 49-32659(1974) disclosed an aromatic polyamide composition comprising a non-modified wholly aromatic polyamide and a modified aromatic polyamide containing, as an indispensable comonomer, a sulfone-substituted xylylene diamine, and a method for producing filaments or fibers from the above-mentioned aromatic polyamide composition. According to the process of the above-mentioned publication, the filaments produced from the aromatic polyamide composition were heat treated in a relaxed condition, at a temperature of 250° C., for 20 minutes, so as to reduce the thermal shrinkage of the filaments. The resultant filaments exhibited an improved dyeing property. However, in spite of the above-mentioned relaxing operation, the relaxed filaments exhibited an undesirably large shrinkage of more than 30% at a temperature of 300° C. The above-mentioned publications contained no example in which the aromatic polyamide filaments are produced from the compositions at a high temperature of 300° C. or more. Also, it was found that the shaped articles such as filaments and films, made of the compositions disclosed in the above-mentioned publications tended to readily shrink, decompose, discolor or deteriorate at a high temperature of 300° C. or more.

Accordingly, it is clear that the above-mentioned conventional aromatic polyamide compositions are not suitable as materials for producing the shaped articles which are highly resistant to a high temperature of 300° C. or more. This is because the sulfone radical or its alkali metal, or alkaline earth metal salt radical, in the compositions has a poor thermal stability.

Furthermore, it is known that an artificial polymer fiber having an improved dyeing property can be prepared from a polymer which exhibits a poor dyeing property by surrounding a fiber core, consisting of the polymer having a poor dyeing property and extending along the longitudinal axis of the fiber, with a sheath consisting of another polymer having a satisfactory dyeing property. However, the production of such a core-in-sheath type composite fiber is very complicated and expensive. Therefore, if it is possible, it is very desirable to provide a core-in-sheath type fiber having a satisfactory dyeing property which has been converted from a simple aromatic polyamide fiber comprising a single aromatic polyamide material. However, such type of aromatic polyamide fiber has never been known.

Moreover, it is known that a conventional rayon fiber and polyacrylonitrile fiber which have been produced by means of a wet spinning process, have a sheath portion and a core portion embedded in the sheath portion and extending along the longitudinal axis of each fiber.

However, in such fibers, the sheath portion is dense and exhibits a poor dyeing property, while the core portion is loose and exhibits a satisfactory dyeing property. Therefore, the sheath portion causes the dyeing property of the fiber as a whole to be less than that of the core portion. Accordingly, from the point of view of dyeing property, it is preferable to remove the sheath portion from the fiber.

DISCLOSURE OF THE INVENTION

An object of the present invention is to provide a core-in-sheath type aromatic polyamide fiber having an excellent dyeing property and satisfactory thermal and mechanical properties, and a process for producing the same.

Another object of the present invention is to provide a core-in-sheath type aromatic polyamide fiber having an excellent dyeing property and a process for producing the same, in which process a composite fiber structure consisting of a sheath portion of the fiber having an excellent dyeing property and a core portion embedded in the sheath portion is formed from a simple fiber structure of the aromatic polyamide fiber.

The above-mentioned objects can be attained by the core-in-sheath type aromatic polyamide fiber of the present invention, which comprises a core portion comprising an aromatic polyamide material and extending along the longitudinal axis of said fiber, and a sheath portion comprising the same aromatic polyamide material as that in said core portion and surrounding said core portion, said core portion being insoluble but said sheath portion being soluble in N-methyl-2-pyrrolidone at a temperature of 35° C.

The above-specified core-in-sheath type aromatic polyamide fiber can be produced by the process of the present invention, which comprises the steps of: extruding a solution of a polymer material comprising at least one aromatic polyamide in an organic solvent into a coagulating bath through a spinning hole to form a coagulated undrawn filament of said polymer material; washing said coagulated undrawn filament with water to remove said organic solvent form said coagulated undrawn filament; drawing said washed filament in hot water; drying said drawn filament, and; heat-treating said dried filament in a dry atmosphere at a temperature of from 200 to 390° C.

DETAILED DESCRIPTION OF THE INVENTION

Figure 1:
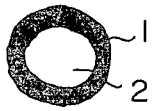
FIGS. 1 through 5 respectively are cross-sectional profiles of core-in-sheath type aromatic polyamide fibers which have been produced in Examples 1 through 5, in accordance with the present invention, and which have been dyed with a dye.

The aromatic polyamide fiber of the present invention has a composite fiber structure consisting of a core portion extending along the longitudinal axis of the fiber and a sheath portion in which the core portion is embedded. It is important that, while the sheath portion and the core portion are made from the same aromatic polyamide material, the solubilities of the sheath and core portions in N-methyl-2-pyrrolidone, at a temperature of 35° C., are different from each other. That is, the sheath portion is soluble and the core portion is insoluble in N-methyl-2-pyrrolidone at 35° C.

This feature results in the sheath portion exhibiting an excellent dyeing property and the core portion exhibiting a poor dyeing property.

Each of the core and sheath portion of the aromatic polyamide fiber comprises an aromatic polyamide material which may comprise at least one aromatic polyamide containing repeating units selected from the group consisting of those of the formulae (I) and (II):

$$\left[ NR_1-Ar_1-\overset{\overset{\displaystyle O}{\|}}{C} \right] \quad \text{(I)}$$

and $$\left[ NR_2-Ar_2-NR_3-\overset{\overset{\displaystyle O}{\|}}{C}-Ar_3-\overset{\overset{\displaystyle O}{\|}}{C} \right] \quad \text{(II)}$$

wherein $Ar_1$, $Ar_2$ and $Ar_3$ respectively represent, independently from each other, an unsubstituted or substituted divalent aromatic radical which comprises a single aromatic ring, or two or more aromatic rings that are condensed together, or are linked together by a single bond, or by a bridging atom or radical, and which is oriented either meta or para, and $R_1$, $R_2$ and $R_3$ respectively represent, independently from each other, a hydrogen atom or an alkyl radical having 1 to 3 carbon atoms.

In the formulae (I) and (II), it is preferable that $Ar_1$, $Ar_2$ and $Ar_3$ be respectively selected, independently from each other, from the group consisting of the radicals of the formulae:

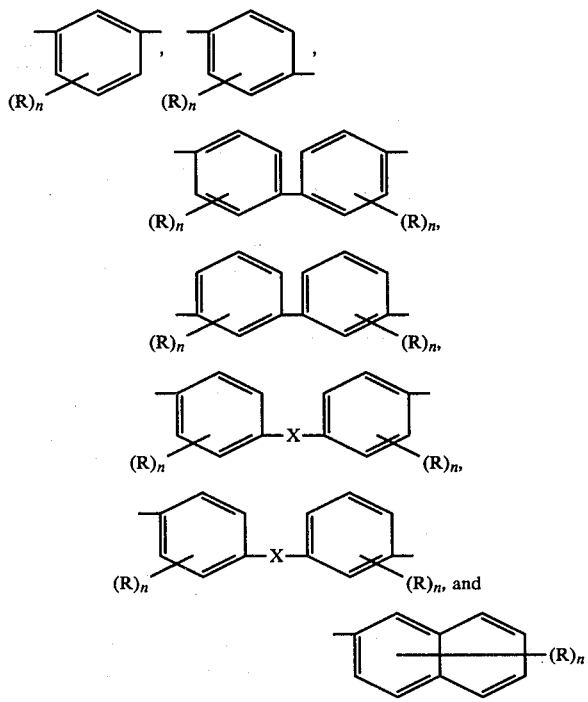

wherein R represents a member selected from the group consisting of lower alkyl radicals having 1 to 6 carbon atoms, lower alkoxy radicals having 1 to 6 carbon atoms, halogen atoms and a nitro radical, n represents zero or an integer of from 1 to 4 and X represents a member selected from the group consisting of

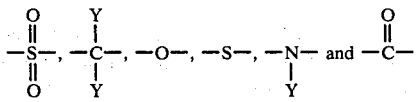

wherein Y represents a member selected from the group consisting of a hydrogen atom and lower alkyl radicals having 1 to 6 carbon atoms.

Also, in the formulae (I) and (II), it is more preferable that $Ar_1$, $Ar_2$ and $Ar_3$ respectively represent, independently from each other, a member selected from p-phenylene radical, m-phenylene radical, biphenylene and radicals of the formulae:

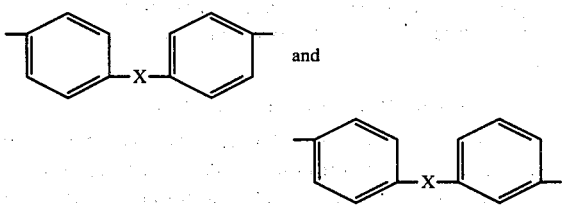

wherein X represents a member selected from

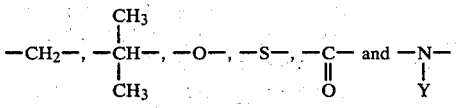

in which Y represents a hydrogen atom or an alkyl radical having 1 to 3 carbon atoms.

Furthermore, in the formulae (I) and (II), it is still more preferably that $Ar_1$, $Ar_2$ and $Ar_3$ be respectively a p-phenylene or m-phenylene radical.

Moreover, it is preferable that the aromatic polyamide contain the repeating units of the formula (II) in which $Ar_2$ and $Ar_3$ are respectively a p-phenylene or m-phenylene radical, most preferably, a m-phenylene radical.

The aromatic polyamide may contain 30 molar % or less of one or more comonomers, for example, aliphatic diamines, such as hexamethylene diamine and piperazine, and an aliphatic dicarboxylic acid, such as adipic acid, based on the entire molar amount of the comonomers contained in the polyamide.

In the core-in-sheath type aromatic polyamide fiber of the present invention, for example, poly-m-phenylene isophthalamide, it is important that the solubility of the sheath portion in N-methyl-2-pyrrolidone at 35° C. be extremely different from that of the core portion.

Usually, the aromatic polyamide materials or articles, for example, a poly-m-phenylene isophthalamide fiber and film, which have not yet been heat-treated or drawn at an elevated temperature, for example, 200 to 390° C., can be dissolved in concentrated sulfuric acid and N-methyl-2-pyrrolidone at a temperature of from 0 to 100° C. However, after the aromatic polyamide materials or articles have been heat-treated or drawn at the elevated temperature, they are soluble only in concentrated sulfuric acid and become insoluble in N-methyl-2-pyrrolidone. This is because the heat-treating or drawing operation at the elevated temperature results in an increase in the degrees of orientation and crystallinity of the polymer molecules in the polymer materials or articles.

In the case of the core-in-sheath type fiber of the present invention, the fiber can be completely dissolved in the concentrated sulfuric acid, while only the sheath portion of the fiber can be dissolved in N-methyl-2-pyrrolidone at 35° C.

The cross-sectional area of the sheath portion in the fiber of the present invention preferably corresponds to 10 to 80% of the entire cross-sectional area of the fiber. Therefore, the cross-sectional area of the core portion in the fiber corresponds to 20 to 90% of the entire cross-sectional area of the fiber.

The core-in-sheath type fiber of the present invention is dyed with an acid dye at a usual dyeing temperature, for example, 130° C., only the sheath portion having an annular cross-sectional profile is colored and even after 5 hours or more of the dyeing operation has been completed, the core portion is substantially not colored.

The shape of the cross-sectional profile of the fiber of the present invention is not limited to a specific shape. Usually, the fiber of the present invention has a circular or elliptical cross-sectional profile, while conventional aromatic polyamide fibers exhibit a cocoon-shaped cross-sectional profile.

Usually, the core-in-sheath type fiber of the present invention has a coarse peripheral surface on which a number of grooves are extended along the longitudinal axis of the fiber, while the conventional aromatic polyamide fibers have smooth peripheral surfaces under electron microscopic observation. However, sometimes, the core-in-sheath type fiber of the present invention has a smooth, shiny peripheral surface, and still exhibits an excellent dyeing property. Therefore, it is evident that the excellent dyeing property of the core-in-sheath type fiber of the present invention is not necessarily derived from the coarse peripheral surface thereof.

The core-in-sheath type aromatic polyamide fiber of the present invention exhibits not only the excellent dyeing property, but also, an excellent thermal resistance and flame-retarding property. Therefore, the core-in-sheath type fiber of the present invention can be utilized for producing, textile materials which are required not only to exhibit an excellent thermal resistance and flame-retarding property, but also, to be beautifully colored with conventional dyes.

The core-in-sheath type aromatic polyamide fiber of the present invention may be used as a material for adsorbing therein water or various organic compounds or for fixing therewith various inorganic compounds or enzymes, by utilizing the sheath portion thereof having a low density.

The core-in-sheath type aromatic polyamide fiber of the present invention can be produced by the process in which a spinning solution of the aromatic polyamide material comprising at least one aromatic polyamide in an organic solvent is extruded through a spinning hole into a coagulating bath to form an undrawn filament of the aromatic polyamide material, the undrawn filament is washed with water, the washed filament is drawn in hot water, the drawn filament is dried and, finally, the dried filament is heat-treated in a dry atmosphere at an elevated temperature, optionally, while additionally drawing the dried filament.

The solvents for preparing the spinning solution of the aromatic polyamide material is not limited to a specific group of the solvents. However, usually, the solvent is selected from basic amide solvents, for instance, N,N'-dinethyl formamide, N,N'-dimethyl acetamide and N-methyl-2-pyrrolidone. The spinning solution of the aromatic polyamide material may or may not contain a solubilizing auxiliary agent consisting of at least one inorganic compound selected from calcium chloride, zinc chloride, lithium chloride and magnesium chloride.

The coagulating conditions for the extruded spinning solution are variable depending on the composition, temperature and viscosity of the spinning solution and the composition of the coagulating bath. Usually, the coagulating bath consists of an aqueous solution containing at least one coagulating agent, for example, calcium chloride, zinc chloride and magnesium chloride. The coagulating bath may contain the same types of inorganic compound and solvent as those contained in the spinning solution.

The temperature of the coagulating bath is usually in a range of from 50 to 150° C.

The coagulated aromatic polyamide material filament is washed with water, usually at a temperature of from 0° C. to 100° C., preferably, at a temperature of from 0 to 50° C. more preferably, from 0 to 25° C., and then again, with cold water or hot water, so as to decrease the content of the solvent in the filament. The content of solvent which it is permisslbe to retain in the washed filament is variable depending on the drawing conditions to be applied to the washed filament in the hot water and the additional drawing conditions to be applied to the drawn filament in the dry atmosphere. However, usually, it is preferable that the content of the solvent retained in the washed filament be in a range of from 0.1 to 6% by weight. Such content of the solvent is usually lower than that in the conventional washed filament which has been prepared in accordance with a usual process for producing a conventional aromatic polyamide fiber having a high degree of tensile strength.

The washed filament is drawn in hot water which has a temperature of 90° C. or more. Usually, this drawing operation is carried out at a draw ratio of from 1.4 to 3.5.

Next, the drawn filament is dried, preferably, at a temperature of 180° C. or less, more preferably, 150° C. or less, most preferably, 120° C. or less. A drying temperature higher than 180° C. is sometimes not desirable for obtaining the core-in-sheath type structure of the aromatic polyamide fiber.

Finally, the dried filament is heat-treated in a dry atmosphere, optionally, while being additionally drawn, at a temperature of from 200 to 390° C., preferably, from 250 to 360° C., most preferably, from 320 to 360° C.

When the dried filament is additionally drawn in the dry atmosphere, it is preferable that the draw ratio $DR_1$ in the drawing operation in the hot water and the draw ratio $DR_2$ in the drawing operation in the dry atmosphere satisfy the relationship:

$$DR_1 \times DR_2 < 4.0$$

wherein $DR_1 > 1.5$, more preferably, $$DR_1 \times DR_2 < 3.5$$

wherein $DR_1 > 2.5$.

If $DR_1 \times DR_2 \geqq 4.0$, wherein $DR_1 > 1.5$, the resultant drawn filament sometimes has no core-in-sheath structure of the present invention or a low tensile strength. Also, even if $DR_1 \times DR_2 < 4.0$, if $DR_1 \leqq 1.5$, sometimes, the resultant drawn filament exhibits no core-in-sheath structure of the present invention or a poor tensile strength.

The core-in-sheath type aromatic polyamide fiber of the present invention may contain any additives, for example, flame-retarding agent, photo-stabilizer, antistatic agent and delustering agent, unless the additives obstruct the objects of the present invention.

The features and advantages of the present invention will be further illustrated by the examples set forth below. However, the examples are only illustrative and should in no way be interpreted as limiting the scope of the present invention.

In the examples, the solubility of the fiber in N-methyl-2-pyrrolidone, the shrinkage of the fiber at a temperature of 300° C., which is a parameter of the thermal property of the fiber, and the dyeing property of the fiber were measured in accordance with the following procedures.

Solubility in N-methyl-2-pyrrolidone

A mass of fibers having a length of 5 cm, to be tested was opened, washed with methyl alcohol for 30 minutes and, then, with chloroform for 30 minutes to remove oily materials from the fibers, and then, dried at a temperature of 105° C., for 2 hours, under a vacuum condition. About 0.5 g of the dried fibers were accurately weighed. The weight of the fibers was represented by $W_0$. The fibers were treated with 20 ml of N-methyl-2-pyrrolidone, at a temperature of 35° C., for one hour, while stirring the treating mixture. Then, the treating mixture was filtered with a glass filter to separate the un-dissolved portion of the fibers from the resultant solution. The filtered fibers were washed with N-methyl-2-pyrrolidone, with water and, then, with methyl alcohol, and dried at a temperature of 105° C., for 2 hours, under a vacuum condition. The dried fibers were accurately weighed. The weight of the dried fibers was represented by $W_1$.

The dissolved amount of the fibers was calculated in accordance with the equation:

$$\text{Dissolved amount (\%)} = \frac{W_0 - W_1}{W_0} \times 100$$

Dyeing property (K/S value)

A mass of fibers having a length of about 5 cm was opened and, then, dyed under the following conditions.

| | |
|---|---|
| Amount of fibers | 10.0 g |
| dyeing liquid | |
| Dye (Supranol Blue GL, C.I. Acid Blue 102) | 0.6 g |
| Ammonium sulfate | 22.5 g |
| Acetic acid | 6.0 g |
| Carrier (p-phenylphenol) | 2.0 g |
| Water | 303.0 g |
| Dyeing temperature | 130° C. |
| Dyeing time | 90 minutes. |

The dyed fiber was soaped with a soaping aqueous solution of 1.5 g of sodium carbonate in 300 g of water, at a temperature of 80° C., for 20 minutes. The soaped fibers were placed in a cell and subjected to a measurement of reflectivity (R) with regard to a visible ray having a wave length of 500 nm by using a spectrophotometer. The K/S value of the fibers was calculated in accordance with the equation:

$$K/S \text{ value} = \frac{(1-R)^2}{2R}.$$

Shrinkage at 300° C.

A length $l_0$ was marked on a filament to be tested. The marked filament was heat-treated at a temperature of 300° C., for 30 minutes, under a free condition. After the heat treatment, the length l of the marked portion of the filament was measured. The shrinkage $S_{300}$ of the filament at 300° C. was obtained from the equation:

$$S_{300}(\%) = \frac{l_0 - l}{l_0} \times 100.$$

Also, the inherent viscosity (I.V.) of the aromatic polyamide material was determined in such a manner that about 50 mg of an aromatic polyamide material were accurately weighed, and then, dissolved in 10.0 ml of a concentrated sulfuric acid at room temperature. A solution having a concentration of C (g/100 ml) was obtained. The resultant solution was flowed down through an Ostwald's viscometer and a time (t) in seconds necessary for passing the solution through the viscometer was measured. The same measurement was applied to the concentrated sulfuric acid. The passing time ($t_0$) in seconds for the concentrated sulfuric acid was measured. The inherent viscosity of the aromatic polyamide material was calculated in accordance with the equation:

$$\text{I.V.} = \frac{l_n\, t/t_0}{C}.$$

EXAMPLE 1

A spinning solution was prepared by dissolving 22 parts by weight of an aromatic polyamide material consisting of a condensation product of m-phenylenediamine with isophthalic acid chloride and having an inherent viscosity of 1.85, and 7.7 parts by weight of calcium chloride in 100 parts by weight of N-methyl-2-pyrrolidone. The spinning solution was extruded through a spinneret having 100 spinning holes, each having a diameter of 0.08 mm, into a coagulating bath consisting of an aqueous solution of 50% by weight of calcium chloride, at an extruding rate of 2 g/min, to coagulate the extruded filamentary streams of the spinning solution.

The coagulated filaments were washed with cold water at a temperature of 15° C. and, then, with hot water at a temperature of 70° C. The washed filaments contained 1.0% by weight of the solvent N-methyl-2-pyrrolidone. The washed filaments were drawn in hot water, at a temperature of 100° C., at a draw ratio ($DR_1$) of 2.63. The drawn filaments were dried at a temperature of from 110° C. to 120° C. by using drying rollers.

The dried filaments were heat-treated on a heating plate at a temperature of 350° C. white additionally drawing the filaments at a draw ratio ($DR_2$) of 1.2.

$$DR_1 \times DR_2 = 3.16 < 4.0$$

$$DR_1 = 2.63 > 1.5.$$

The heat-treated, additionally drawn filaments were wound on a bobbin by using a winder. The resultant filament yarn had a yarn count of about 200 denier/100 filaments, and average tensile strength and ultimate elongation of individual filament of b 3.8 g/d and 68%, respectively.

The dissolved amount of the filaments in N-methyl-2-pyrrolidone was 31% and the shrinkage of the filaments at 300° C. was 8.0%. The dyed filaments also exhibited a K/S value of 9.0. The cross-sectional profile is illustrated in FIG. 1, wherein a sheath portion 1 was colored dark and a core portion 2 was not colored.

COMPARISON EXAMPLE 1

A spinning solution of 22% by weight of poly-m-phenylene isophthalamide having an inherent viscosity of 1.80, was extruded through a spinneret having 100 spinning holes, each having a diameter of 0.08 mm, at an extruding rate of 2 g/min. into a coagulating bath consisting of an aqueous solution of 43% by weight of calcium chloride at a temperature of 95° C.

The resultant coagulated filaments were washed with cold water at a temperature of 20° C. and, then, with hot water at a temperature of 70° C. The washed filaments contained the solvent in a content of 10% by weight.

The washed filaments were drawn in boiling water at a draw ratio ($DR_1$) of 2.30 which was larger than 1.5.

The drawn filaments were dried at a temperature of 130° C. by using drying rollers.

The dried filaments were heat-treated on a heating plate at a temperature of 350° C., while additionally drawing the filaments at a draw ratio ($DR_2$) of 1.82, and finally, the drawn filaments were wound on a bobbin by using a winder. In this case, it is clear that $$DR_1 \times DR_2 = 4.19 > 4.0 \text{ and}$$

$$DR_1 = 2.3 > 1.5.$$

The resultant filament yarn had a yarn count of 220 denier/100 filaments and exhibited an averaged tensile strength and ultimate elongation of individual filaments of 5.50 g/d and 36%, respectively.

The dissolved amount in N-methyl-2-pyrrolidone and shrinkage ($S_{300}$) of the filaments were 0% and 5% , respectively. Also, the filament yarn exhibited a K/S value of 0.8 and was very slightly colored with the acid dye.

EXAMPLE 2

Figure 2:
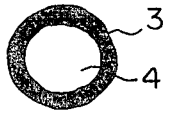

The same procedures as those described in Example 1 were carried out, except that the spinning solution was prepared from 22parts by weight of the same aromatic polyamide material as that described in Example 1, 4.4 parts by weight of calcium chloride and 100 parts by weight of N-methyl-2-pyrrolidone. The resultant filament yarn had a yarn count of 200 denier/100 filaments, and exhibited an average tensile strength and ultimate elongation of individual filaments of 4.4 g/d and 56%, respectively. The dissolved amount in N-methyl-2-pyrrolidone and shrinkage of the filaments were 25% and 12%, respectively, and the K/S value was 8.0. The cross-sectional profile of a dyed filament is illustrated in FIG. 2. In FIG. 2, an annular sheath portion 3 was colored dark blue, but the core portion 4 was not colored.

EXAMPLE 3

A spinning solution was prepared by dissolving 21% by weight of the same aromatic polyamide material as that described in Example 1, in N-methyl-2-pyrrolidone. The spinning solution was extruded through the same spinneret as that described in Example 1, at an extruding rate of 2 g/min. into a coagulating bath consisting of an aqueous solution of 45% by weight of calcium chloride at a temperature of 75° C.

The coagulated filaments were washed with cold water at a temperature of 15° C. and, then, with hot water at a temperature of from 60 to 70° C. The content of the solvent in the washed filaments was 2.3% by weight.

The washed filaments were drawn in boiling water, at a draw ratio ($DR_1$) of 2.86. The drawn filaments were dried at a temperture of from 110° C. to 120° C. by using drying rollers. The dried filaments were heat-treated on a hot plate at a temperature of 350° C., while being additionally drawn at a draw ratio ($DR_2$) of 1.10, and finally, the drawn filaments were wound on a bobbin by using a winder. In this case, it is clear that $$DR_1 \times DR_2 = 3.15 < 4.0 \text{ and}$$

$$DR_1 = 2.86 > 1.5.$$

Figure 3:
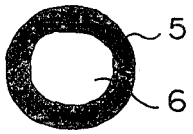

The resultant filament yarn had a yarn count of about 300 denier/100 filaments and exhibited average tensile strength and ultimate elongation of 5.0 g/d and 47% of the individual filaments, respectively. The filament yarn also exhibited a dissolved amount of 12% in N-methyl-2-pyrrolidone, a shrinkage ($S_{300}$) of 8.5% and a K/S value of 7.4. The cross-sectional profile of a dyed filament is illustrated in FIG. 3. In FIG. 3, an annular sheath portion 5 is colored dark blue, but a core portion 6 is not colored.

EXAMPLE 4

A spinning solution was prepared by dissolving 19% by weight of a poly-m-phenylene isophthalamide having an inherent viscosity of 1.75. The spinning solution was extruded through the same spinneret as that described in Example 1, at an extruding rate of 2 g/min., into a coagulating bath consisting of an aqueous solution of 45% by weight of calcium chloride, having a temperature of 65° C.

The coagulated filaments were washed with cold water at a temperature of 20° C. and, then, with hot water at a temperature of 70° C. The content of the solvent retained in the washed filaments was 3.2% by weight.

The washed filaments were drawn in hot water at a draw ratio ($DR_1$) of 2.63. The drawn filaments were dried at a temperature of from 110 to 120° C. on drying rollers. the dried filaments were heat-treated on a hot plate at a temperature of 350° C., while being additionally drawn at a draw ratio ($DR_2$) of 1.20, and the resultant filament yarn was wound on a bobbin by using a winding machine. In this case, it is clear that $$DR_1 \times DR_2 = 3.16 < 4.0, \text{ and}$$

$$DR_1 = 2.63 < 1.5.$$

Figure 4:
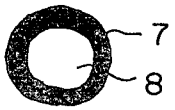

The filament yarn had a yarn count of about 250 denier/100 filaments and exhibited an average tensile strength and ultimate elongation of 4.90 g/d and 70%, of the individual filaments, respectively. Also, the filaments exhibited a dissolved amount of 20%, a shrinkage ($S_{300}$) of 9% and a K/S value of 11.3. A cross-sectional profile of a dyed filament is illustrated in FIG. 4. In FIG. 4, an annular sheath portion 7 is colored dark blue and a core portion 8 is not colored.

EXAMPLE 5

The same procedures as those mentioned in Example 3 were carried out, except that the spinning solution consisted of a solution of 21% by weight of the same polymer as that described in Example 4 in N-methyl-2-pyrrolidone, the draw ratio ($DR_1$) in the hot water was 1.90 and draw ratio ($DR_2$) on the hot plate was 1.70. In this case, it is clear that $$DR_1 \times DR_2 = 3.23 < 4.0, \text{ and}$$

$$DR_1 = 1.90 < 1.5.$$

The resultant filament yarn had a yarn count of about 300 denier/100 filaments and exhibited an average tensile strength and ultimate elongation of 3.6 g/d and 56%, respectively, of the individual filaments.

Figure 5:
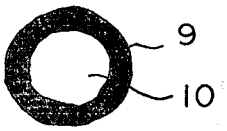

The filament yarn also exhibit a dissolved amount in N-methyl-2-pyrrolidone of 57%, a shrinkage ($S_{300}$) of 36% and a K/S value of 15. A cross-sectional profile of a dyed filament is illustrated in FIG. 5. In FIG. 5, an annular sheath portion 9 is colored dark blue and a core portion 10 is not colored.

We claim:

1. A core-in sheath type aromatic polyamide fiber, comprising a core portion comprising an aromatic polyamide material and extending along the longitudinal axis of said fiber, and a sheath portion comprising the same aromatic polyamide material as that in said core portion and surrounding said core portion, said core portion being insoluble but said sheath portion being solution in N-methyl-2-pyrrolidone at a temperature of 35° C., said fiber having been heat-treated in a dry atmosphere at a temperature of from 200° to 390° C.

2. A core-in-sheath type aromatic polyamide fiber as claimed in claim 1, wherein said aromatic polyamide material comprises at least one aromatic polyamide containing repeating units selected from the group consisting of those of the formulae (I) and (II):

$$\left[ NR_1 - Ar_1 - \overset{\overset{\displaystyle O}{\|}}{C} \right] \quad \text{(I)}$$

and $$\left[ NR_2 - Ar_2 - NR_3 - \overset{\overset{\displaystyle O}{\|}}{C} - Ar_3 - \overset{\overset{\displaystyle O}{\|}}{C} \right] \quad \text{(II)}$$

wherein $Ar_1$, $Ar_2$ and $Ar_3$ respectively represent, independently from each other, an unsubstituted or substituted divalent aromatic radical which comprises a single aromatic ring, or two or more aromatic rings that are condensed together, or are linked together, by a single bond, or by a bridging atom or radical, and which is oriented either meta or para, and $R_1$, $R_2$ and $R_3$ respectively represent, independently from each other, a hydrogen atom or an alkyl radical having 1 to 3 carbon atoms.

3. A core-in-sheath type aromatic polyamide fiber as claimed in claim 2, wherein said $Ar_1$, $Ar_2$ and $Ar_3$ in said formulae (I) and (II) are respectively selected, independently from each other, from the group consisting of the radicals of the formulae:

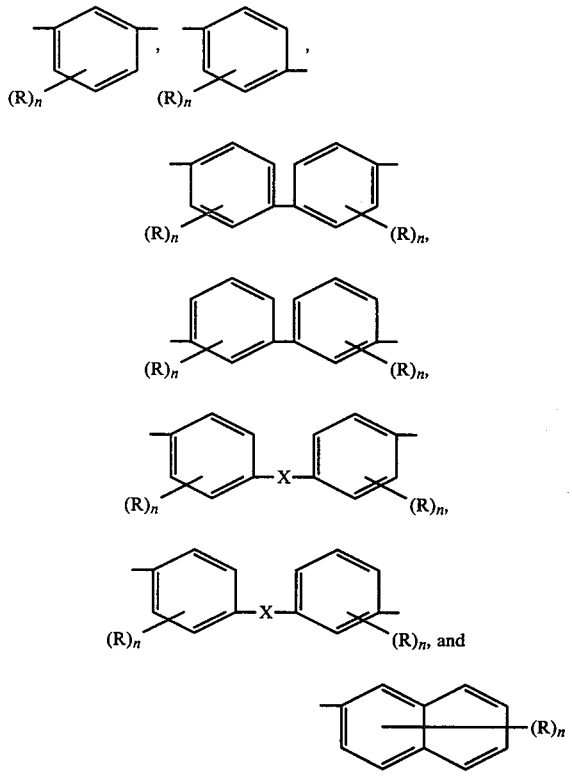

wherein R represents a member selected from the group consisting of lower alkyl radicals having 1 to 6 carbon atoms, lower alkoxy radicals having 1 to 6 carbon atoms, halogen atoms and a nitro radical, n represents zero or an integer of from 1 to 4 and X represents a member selected from the group consisting of

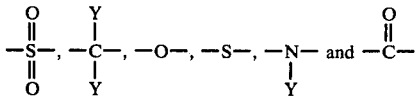

wherein Y represents a member selected from the group consisting of a hydrogen atom and lower alkyl radicals having 1 to 6 carbon atoms.

4. A core-in-sheath type aromatic polyamide fiber as claimed in claim 2, wherein said $Ar_1$, $Ar_2$ and $Ar_3$ in the formulae (I) and (II) respectively represent, independently from each other, a member selected from p-phenylene radical, m-phenylene radical, biphenylene and radicals of the formulae:

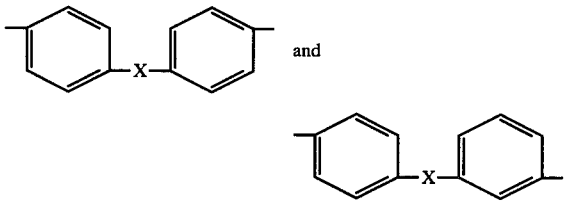

wherein X represents a member selected from

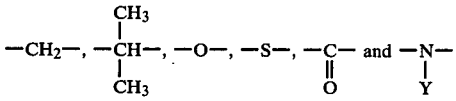

in which Y represents a hydrogen atom or an alkyl radical having 1 to 3 carbon atoms.

5. A core-in-sheath type aromatic polyamide fiber as claimed in claim 2, wherein said aromatic polyamide contains repeating units of the formula (II) in which said $Ar_2$ and $Ar_3$ represent, independently from each other, a m-phenylene or p-phenylene radical.

6. A core-in-sheath type aromatic polyamide fiber as claimed in claim 5, wherein both said $Ar_2$ and $Ar_3$ in the formula (II) represent an m-phenylene radical.

7. A core-in-sheath type aromatic polyamide fiber as claimed in claim 1, wherein the cross-sectional area of said sheath portion corresponds to 10 to 80% of the entire cross-sectional area of said fiber.

* * * * *

UNITED STATES PATENT AND TRADEMARK OFFICE

CERTIFICATE OF CORRECTION

PATENT NO. : 4,309,476

DATED : January 5, 1982

INVENTOR(S) : Tsutomu Nakamura, et al

It is certified that error appears in the above—identified patent and that said Letters Patent is hereby corrected as shown below:

Column 1, line 43: "electricinsulating" should be --electric insulating--.
line 60: "impvor" should be --improv--.

Column 5, line 36: "preferably" should be --preferable--.

Column 10, line 55: "22parts" should be --22 parts--.

Column 11, line 56: "the" should be --The--.
line 64: "$DR_1$=2.63<1.5." should be --$DR_1$=2.63>1.5.--

Column 12, line 4: after "profile", insert --of--.
line 19: "$DR_1$=1.90<1.5." should be --$DR_1$=2.63>1.5.--
line 25: "exhibit" should be --exhibited--.

Signed and Sealed this

Twenty-eighth Day of December 1982

[SEAL]

Attest:

GERALD J. MOSSINGHOFF

Attesting Officer

Commissioner of Patents and Trademarks